US010636408B2

(12) United States Patent
Griffin et al.

(10) Patent No.: US 10,636,408 B2
(45) Date of Patent: Apr. 28, 2020

(54) HEADREST-INTEGRATED ACTIVE NOISE CONTROL

(71) Applicant: The Boeing Company, Chicago, IL (US)

(72) Inventors: Steven Griffin, Kihei, HI (US); Adam Robert Weston, Brier, WA (US); Daryn David Kono, Pukalani, HI (US)

(73) Assignee: THE BOEING COMPANY, Chicago, IL (US)

( * ) Notice: Subject to any disclaimer, the term of this patent is extended or adjusted under 35 U.S.C. 154(b) by 0 days.

(21) Appl. No.: 16/145,445

(22) Filed: Sep. 28, 2018

(65) Prior Publication Data

US 2020/0105241 A1 Apr. 2, 2020

(51) Int. Cl.
*G10K 11/178* (2006.01)
*G10K 11/00* (2006.01)

(52) U.S. Cl.
CPC ..... *G10K 11/17823* (2018.01); *G10K 11/002* (2013.01); *G10K 2210/3221* (2013.01)

(58) Field of Classification Search
CPC ..... G10K 11/17813; G10K 11/002; G10K 2210/128; G10K 2210/1281; G10K 2210/1283
USPC ..... 381/13, 71.2, 71.4, 71.8, 71.11, 94.1, 381/94.3, 94.8, 95, 97, 98, 104; 297/200, 297/218, 341, 452.18, 452.58
See application file for complete search history.

(56) References Cited

U.S. PATENT DOCUMENTS

| | | | | |
|---|---|---|---|---|
| 5,251,263 | A | 10/1993 | Andrea et al. | |
| 5,408,685 | A * | 4/1995 | Kennedy | H03G 3/34 381/13 |
| 5,754,662 | A * | 5/1998 | Jolly | G10K 11/178 381/71.4 |
| 5,845,236 | A | 12/1998 | Jolly et al. | |
| 5,852,667 | A | 12/1998 | Pan et al. | |
| 6,305,749 | B1 | 10/2001 | O'Connor et al. | |
| 2006/0285697 | A1 | 12/2006 | Nishikawa et al. | |
| 2011/0007907 | A1 * | 1/2011 | Park | G10K 11/178 381/71.8 |
| 2012/0097477 | A1 | 4/2012 | Sekine et al. | |
| 2013/0129108 | A1 | 5/2013 | Wurm | |
| 2014/0112490 | A1 * | 4/2014 | Caillet | B60N 2/879 381/71.4 |
| 2016/0039320 | A1 | 2/2016 | Subat et al. | |

(Continued)

*Primary Examiner* — Paul Kim
*Assistant Examiner* — Friedrich Fahnert
(74) *Attorney, Agent, or Firm* — Coats & Bennett, PLLC

(57) ABSTRACT

Active noise control (ANC) is performed within a vehicle. Suppressed sound is produced by suppressing frequencies of ambient sound above a threshold frequency that enter an interior cavity of a sound-suppressing enclosure disposed within, and spaced from, interior walls of the vehicle. A microphone disposed within the interior cavity of the sound-suppressing enclosure receives feedback comprising a combination of the suppressed sound produced by the sound-suppressing enclosure and antinoise produced by one or more speakers mounted to a headrest disposed within the interior cavity of the sound-suppressing enclosure. The speakers are controlled to produce the antinoise based on the feedback, such that the antinoise destructively interferes with frequencies of the suppressed sound that are above the threshold frequency.

22 Claims, 14 Drawing Sheets

(56) References Cited

U.S. PATENT DOCUMENTS

| | | | | |
|---|---|---|---|---|
| 2016/0100250 | A1 | 4/2016 | Baskin et al. | |
| 2016/0284337 | A1 | 9/2016 | Inoue | |
| 2016/0286303 | A1 | 9/2016 | Roberts | |
| 2017/0106775 | A1 | 4/2017 | Takada et al. | |
| 2017/0267138 | A1 | 9/2017 | Subat et al. | |
| 2018/0056832 | A1 | 3/2018 | Oswald et al. | |
| 2018/0118063 | A1 | 5/2018 | Oswald et al. | |
| 2018/0281965 | A1* | 10/2018 | Pons | B60N 2/914 |
| 2019/0027128 | A1* | 1/2019 | Araki | B64D 11/06 |
| 2019/0118688 | A1* | 4/2019 | Fujikake | B60N 2/879 |
| 2019/0232840 | A1 | 8/2019 | Close | |

* cited by examiner

HEADREST-INTEGRATED ACTIVE NOISE CONTROL

TECHNOLOGICAL FIELD

The present disclosure relates generally to the field of active noise control (ANC). More specifically the present disclosure relates to the field of devices for suppressing noise affecting vehicle passengers.

BACKGROUND

Many environments are inherently noisy. Examples of such environments include roadways, vehicle interiors, manufacturing plants, construction sites, and many other environments that include vehicles and/or heavy machinery. To increase personal comfort in such environments, engineers generally incorporate sound suppressing techniques into their designs. Vehicle interiors, in particular, often include noise suppressing design features which give passengers an increased feeling of luxury and comfort. Accordingly, solutions that are designed to suppress noise are often highly-desired.

SUMMARY

Aspects of the present disclosure are generally directed to active noise control (ANC). Particular aspects include an ANC system that comprises a sound-suppressing enclosure disposed within, and spaced from, interior walls of a vehicle. The sound-suppressing enclosure has an interior cavity and is configured to produce suppressed sound by suppressing frequencies of ambient sound above a threshold frequency that enter the interior cavity. The ANC system further comprises a headrest disposed within the interior cavity of the sound-suppressing enclosure. The ANC system further comprises one or more speakers mounted to the headrest and configured to produce antinoise that destructively interferes with frequencies of the suppressed sound that are below the threshold frequency. The ANC system further comprises a microphone disposed within the interior cavity of the sound-suppressing enclosure. The microphone is configured to receive feedback comprising a combination of the suppressed sound produced by the sound-suppressing enclosure and the antinoise produced by the speakers. The ANC system further comprises processing circuitry communicatively coupled to the speakers and the microphone. The processing circuitry is configured to control the speakers to produce the antinoise based on the feedback received by the microphone.

In some aspects, the processing circuitry comprises a proportional integral (PI) controller configured to produce a control signal based on the feedback received by the microphone, and filtering circuitry communicatively coupled to the PI controller. The filtering circuitry is configured to generate a corrected control signal based on the control signal from the PI controller and a configurable filtering parameter, and send the corrected control signal to the speakers to control the speakers to produce the antinoise. In some such aspects, the ANC system further comprises a tuning microphone disposed within the interior cavity of the sound-suppressing enclosure and spaced apart from the microphone. The tuning microphone is configured to receive further feedback comprising a different combination of the suppressed sound produced by the sound-suppressing enclosure and the antinoise produced by the speakers. In some such aspects, the ANC system further comprises tuning circuitry communicatively coupled to the tuning microphone and the filtering circuitry. The tuning circuitry is configured to store different values of the configurable filtering parameter in the filtering circuitry over time based on the further feedback from the tuning microphone.

In some aspects, the headrest comprises a center section and flanges extending away from the center section on opposing lateral sides of the center section. At least one of the speakers is mounted to each of the flanges. In some such aspects, the speakers mounted to the flanges are configured to project the antinoise at respective projection axes that intersect at an angle between 10 and 90 degrees.

In some aspects, to suppress the frequencies above the threshold frequency, the sound-suppressing enclosure is configured to, at a given listening position, suppress the frequencies above the threshold frequency by amounts respectively greater than any respective constructive interference of the frequencies above the threshold frequency induced by the antinoise.

In some aspects, to destructively interfere with the frequencies below the threshold frequency, the antinoise is configured to, at a given listening position, destructively interfere by amounts respectively greater than any respective amplification of the frequencies below the threshold frequency induced by the sound-suppressing enclosure.

In some aspects, the sound-suppressing enclosure and processing circuitry are configured to jointly provide a peak power reduction of sound energy at a frequency below 200 Hz.

In some aspects, the processing circuitry is configured to control the speakers to produce the antinoise without feed-forward control.

Other aspects include an aircraft. The aircraft comprises a passenger cabin, and a seat disposed within the passenger cabin. The aircraft further comprises a sound-suppressing enclosure disposed within, and spaced from, interior walls of the passenger cabin. The sound-suppressing enclosure has an interior cavity and is configured to produce suppressed sound by suppressing frequencies of ambient sound above a threshold frequency that enter the interior cavity. The aircraft further comprises a headrest mounted to the seat and disposed within the interior cavity of the sound-suppressing enclosure. The aircraft further comprises one or more speakers mounted to the headrest and configured to produce antinoise that destructively interferes with frequencies of the suppressed sound that are above the threshold frequency. The aircraft further comprises a microphone disposed within the interior cavity of the sound-suppressing enclosure. The microphone is configured to receive feedback comprising a combination of the suppressed sound produced by the sound-suppressing enclosure and the antinoise produced by the speakers. The aircraft further comprises processing circuitry communicatively coupled to the speakers and the microphone. The processing circuitry is configured to control the speakers to produce the antinoise based on the feedback received by the microphone.

In some aspects, the processing circuitry comprises a proportional integral (PI) controller configured to receive the feedback from the microphone and produce a control signal, and filtering circuitry communicatively coupled to the PI controller. The filtering circuitry is configured to generate a corrected control signal based on the control signal from the PI controller, and send the corrected control signal to the speakers to produce the antinoise.

In some aspects, the headrest comprises a center section and flanges extending away from the center section on opposing lateral sides of the center section. At least one of the speakers is mounted to each of the flanges. In some such aspects, the speakers are configured to project the antinoise at respective projection axes that intersect at an angle between 10 and 90 degrees.

In some aspects, to suppress the frequencies of ambient sound above the threshold frequency, the sound-suppressing enclosure is configured to, at a given listening position, suppress the frequencies above the threshold frequency by amounts respectively greater than any respective constructive interference of the frequencies above the threshold frequency induced by the antinoise.

In some aspects, to destructively interfere with the frequencies below the threshold frequency, the antinoise is configured to, at a given listening position, destructively interfere by amounts respectively greater than any respective amplification of the frequencies below the threshold frequency induced by the sound-suppressing enclosure.

In some aspects, the sound-suppressing enclosure and processing circuitry are configured to jointly provide a peak power reduction of sound energy at a frequency below 200 Hz.

In some aspects, the processing circuitry is configured to control the speakers to produce the antinoise without feedforward control.

Other aspects include a method of performing active noise control (ANC) within a vehicle. The method comprises producing suppressed sound by suppressing frequencies of ambient sound above a threshold frequency that enter an interior cavity of a sound-suppressing enclosure disposed within, and spaced from, interior walls of the vehicle. The method further comprises receiving, by a microphone disposed within the interior cavity of the sound-suppressing enclosure, feedback comprising a combination of the suppressed sound produced by the sound-suppressing enclosure and antinoise produced by one or more speakers mounted to a headrest disposed within the interior cavity of the sound-suppressing enclosure. The method further comprises controlling the speakers to produce the antinoise based on the feedback, such that the antinoise destructively interferes with frequencies of the suppressed sound that are below the threshold frequency.

In some aspects, controlling the speakers to produce the antinoise based on the feedback comprises using a proportional integral (PI) controller to produce a control signal based on the feedback, using filtering circuitry to generate a corrected control signal based on the control signal, and sending the corrected control signal to the speakers to control the speakers to produce the antinoise.

In some such aspects, suppressing the frequencies above the threshold frequency comprises, at a given listening position, suppressing the frequencies above the threshold frequency by amounts respectively greater than any respective constructive interference of the frequencies above the threshold frequency induced by the antinoise.

In some aspects, controlling the speakers such that the antinoise destructively interferes with the frequencies below the threshold frequency comprises, at a given listening position, controlling the speakers such that the antinoise destructively interferes by amounts respectively greater than any respective amplification of the frequencies below the threshold frequency induced by the enclosure.

In some aspects, the suppressing and the destructive interference jointly provide a peak power reduction of sound energy at a frequency below 200 Hz, and controlling the speakers to produce the antinoise is performed without feedforward control.

The features, functions and advantages that have been discussed can be achieved independently in various aspects or may be combined in yet other aspects, further details of which can be seen with reference to the following description and the drawings.

BRIEF DESCRIPTION OF THE DRAWINGS

Figure 1:
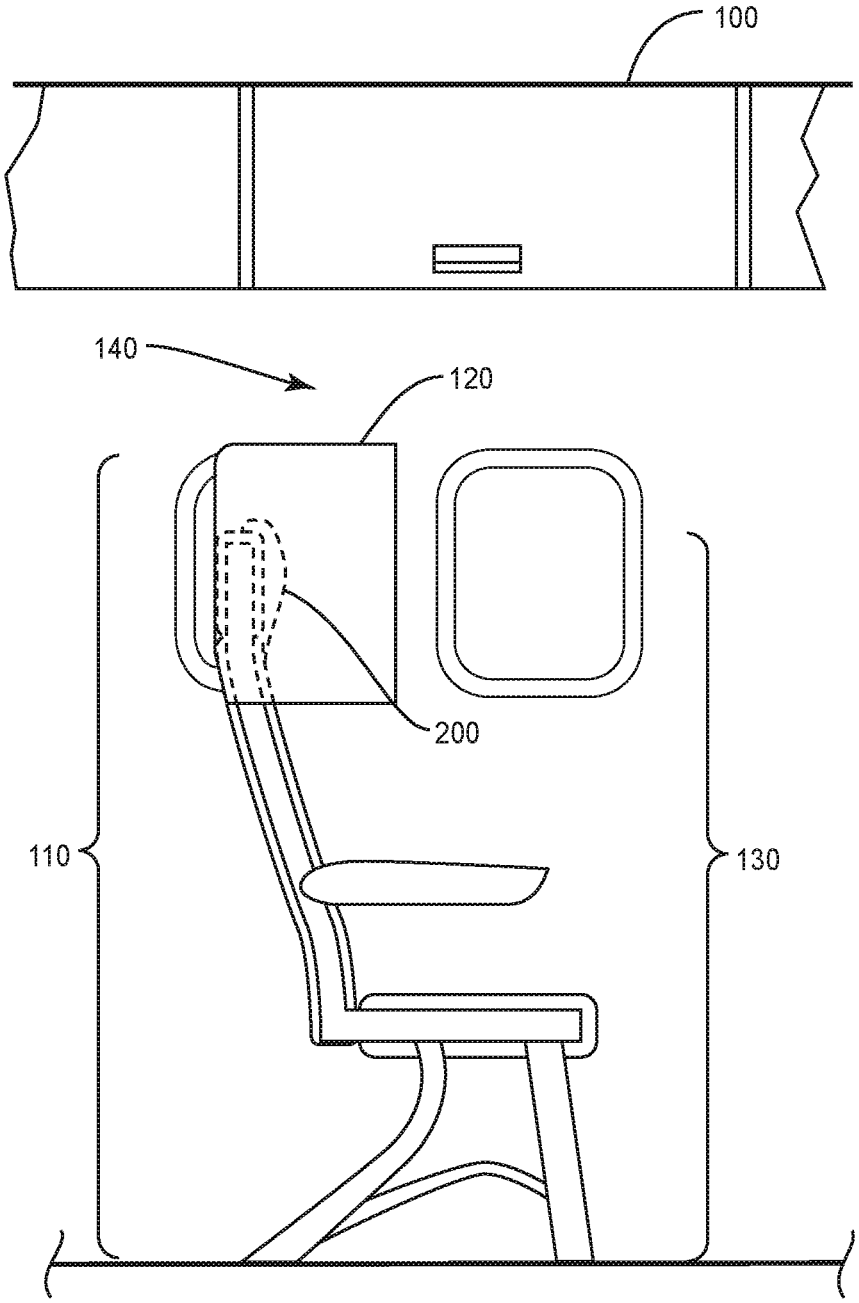

Having thus described variations of the disclosure in general terms, reference will now be made to the accompanying drawings, which are not necessarily drawn to scale. Indeed, aspects of the present disclosure are illustrated by way of example and are not limited by the accompanying figures with like references indicating like elements. In general, the use of a reference numeral should be regarded as referring to the depicted subject matter according to one or more aspects, whereas discussion of a specific instance of an illustrated element will append a letter designation thereto (e.g., discussion of a speaker 210, generally, as opposed to discussion of particular instances of speakers 210*a*, 210*b*).

FIG. 1 is a side-view schematic illustrating a portion of an example vehicle interior, according to aspects of the present disclosure.

Figure 2:
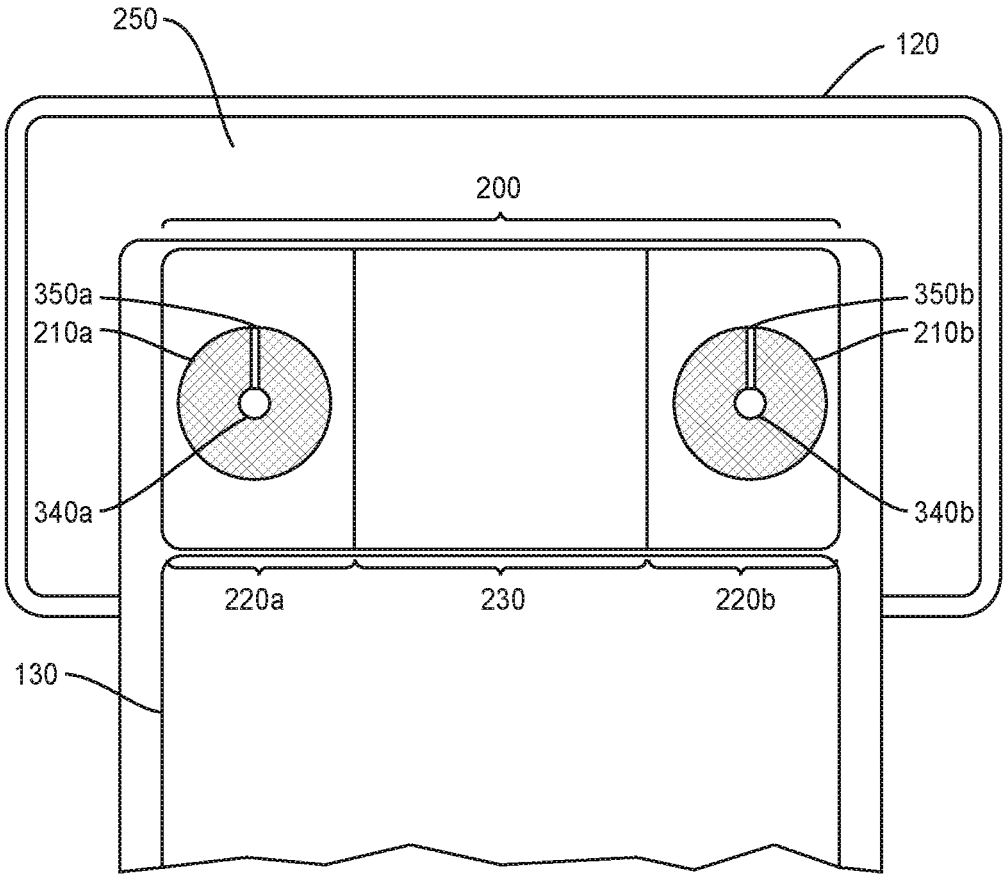

FIG. 2 is a front-view schematic illustrating an example seat assembly, according to aspects of the present disclosure.

Figure 3:
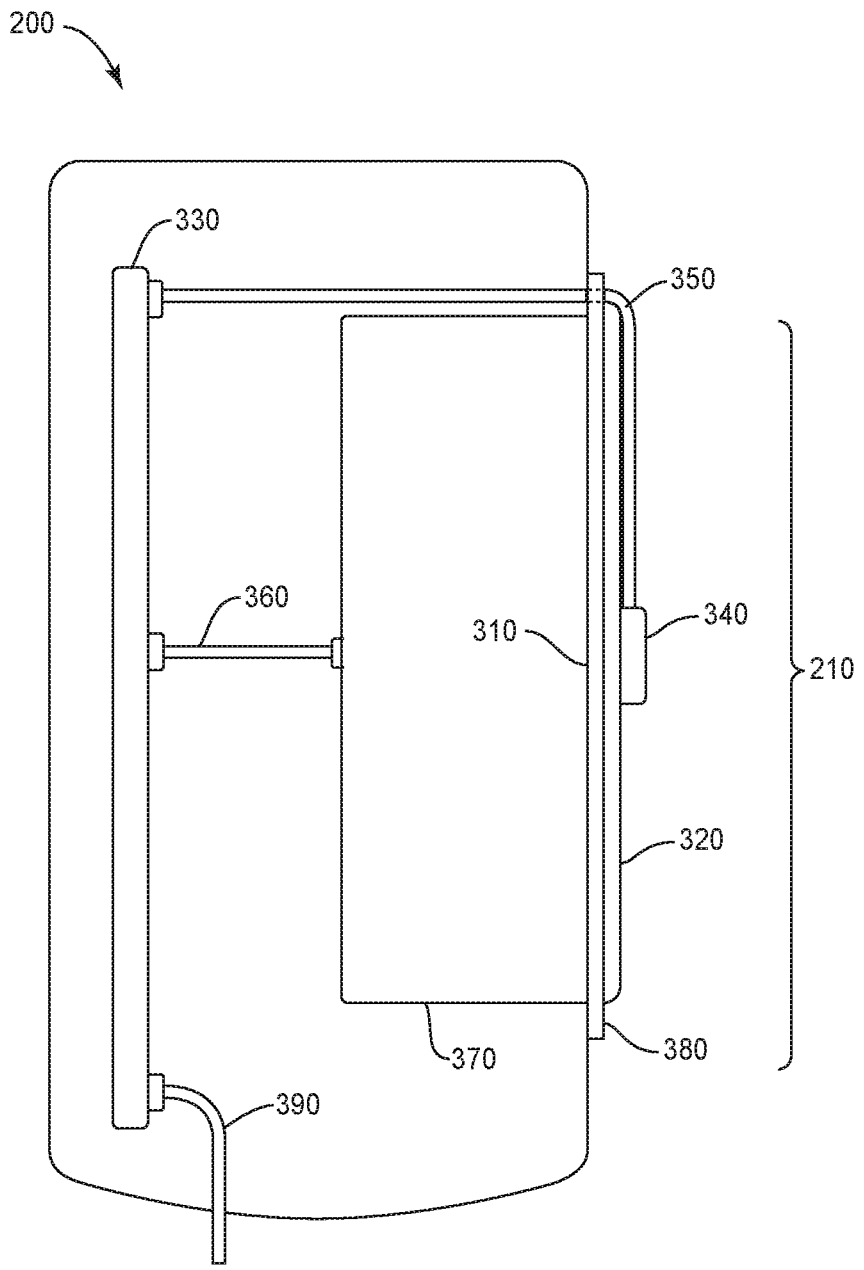

FIG. 3 is a side-view schematic illustrating an example headrest, according to aspects of the present disclosure.

Figure 4A:
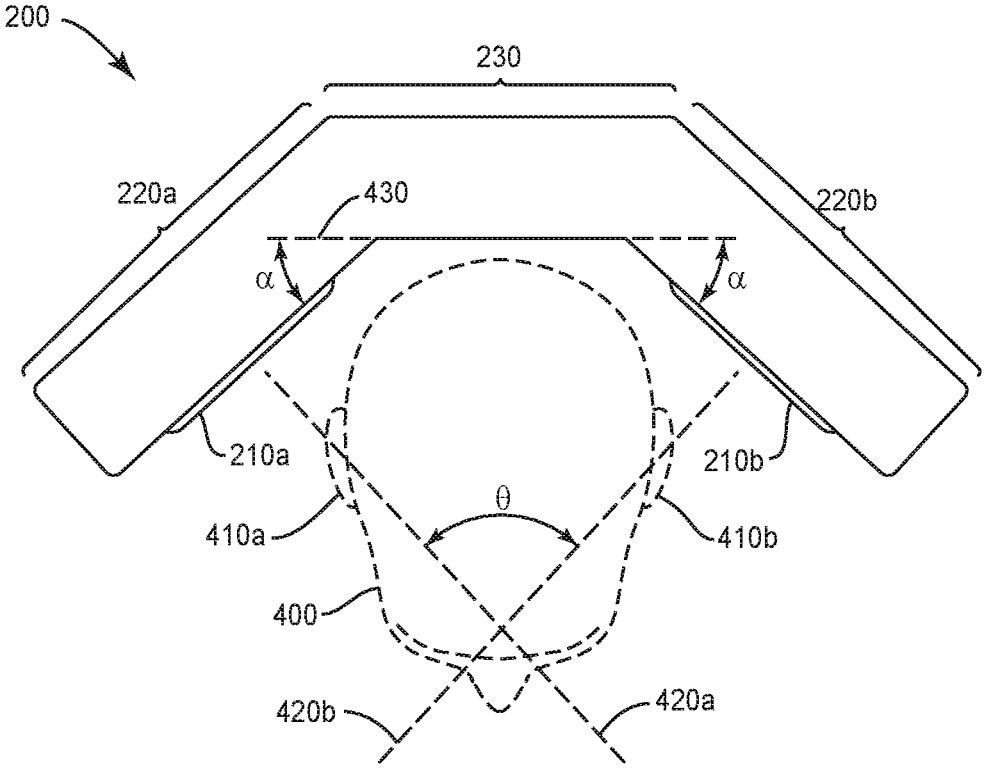

FIG. 4A is a top-view schematic illustrating an example headrest, according to aspects of the present disclosure.

Figure 4B:
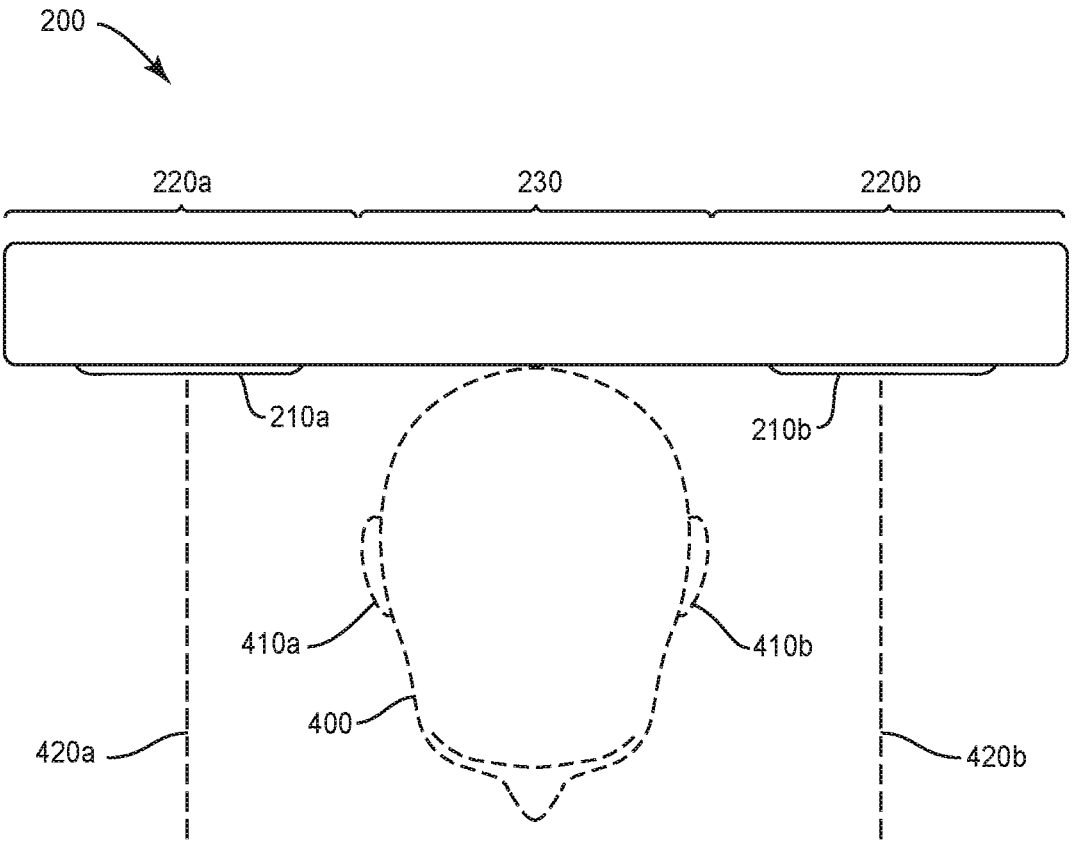

FIG. 4B is a top-view schematic illustrating an example headrest, according to aspects of the present disclosure.

Figure 4C:
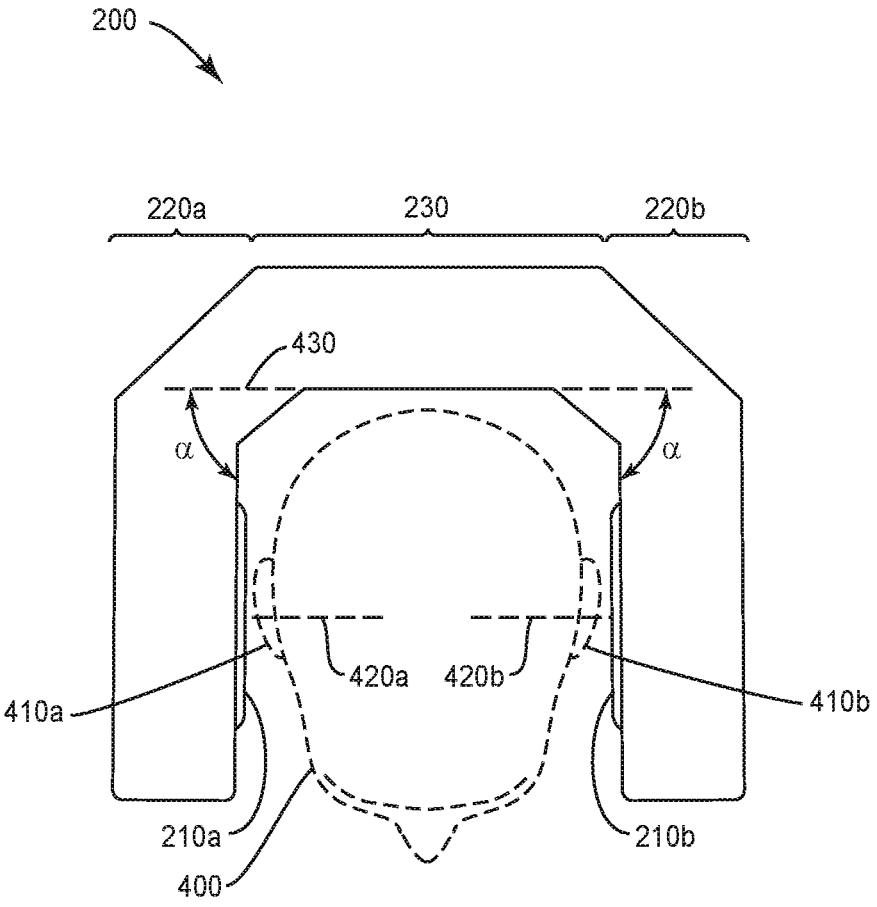

FIG. 4C is a top-view schematic illustrating an example headrest, according to aspects of the present disclosure.

Figure 4D:
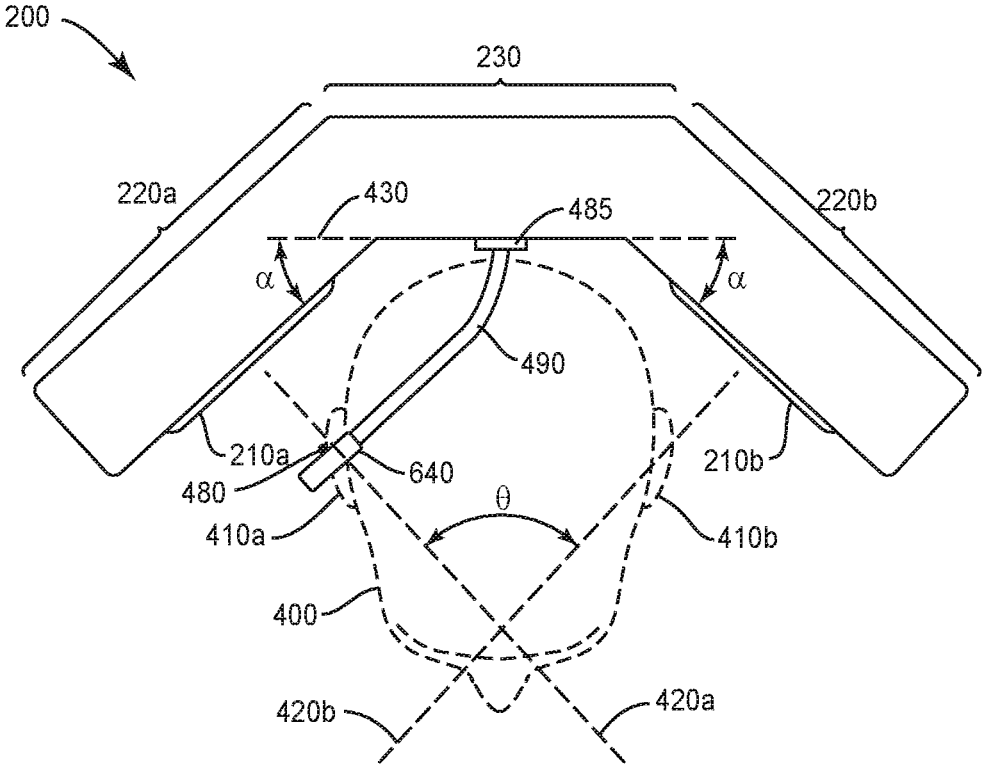

FIG. 4D is a top-view schematic illustrating an example headrest to which a tuning microphone is mounted via a flexible boom, according to aspects of the present disclosure.

Figure 5:
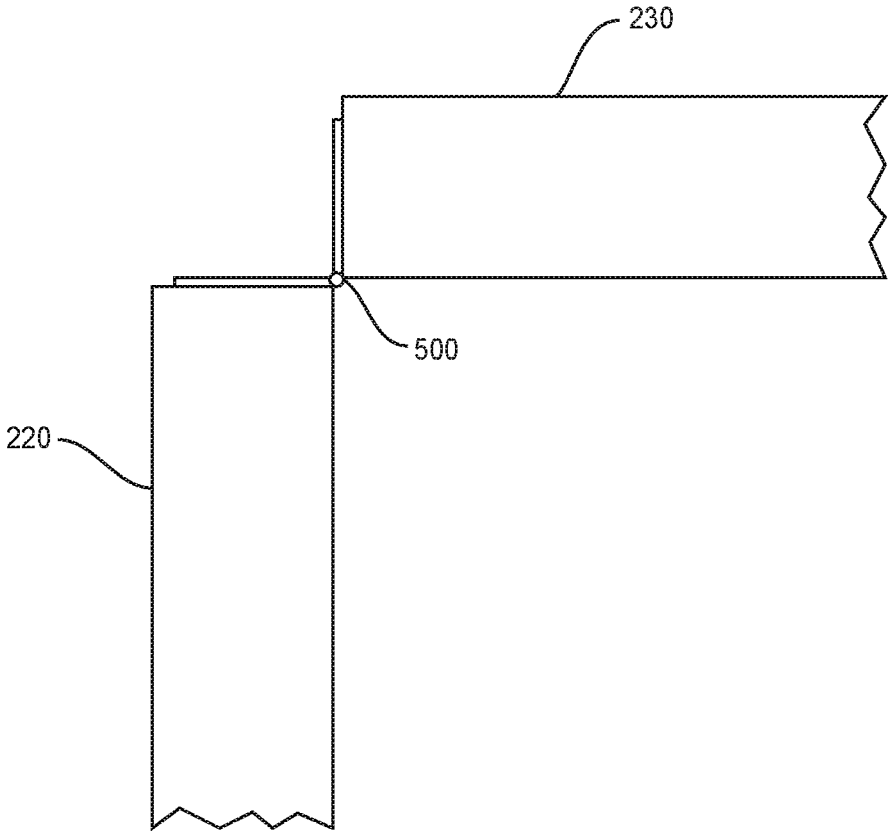

FIG. 5 is a top-view schematic illustrating an example headrest comprising a hinge, according to aspects of the present disclosure.

Figure 6:
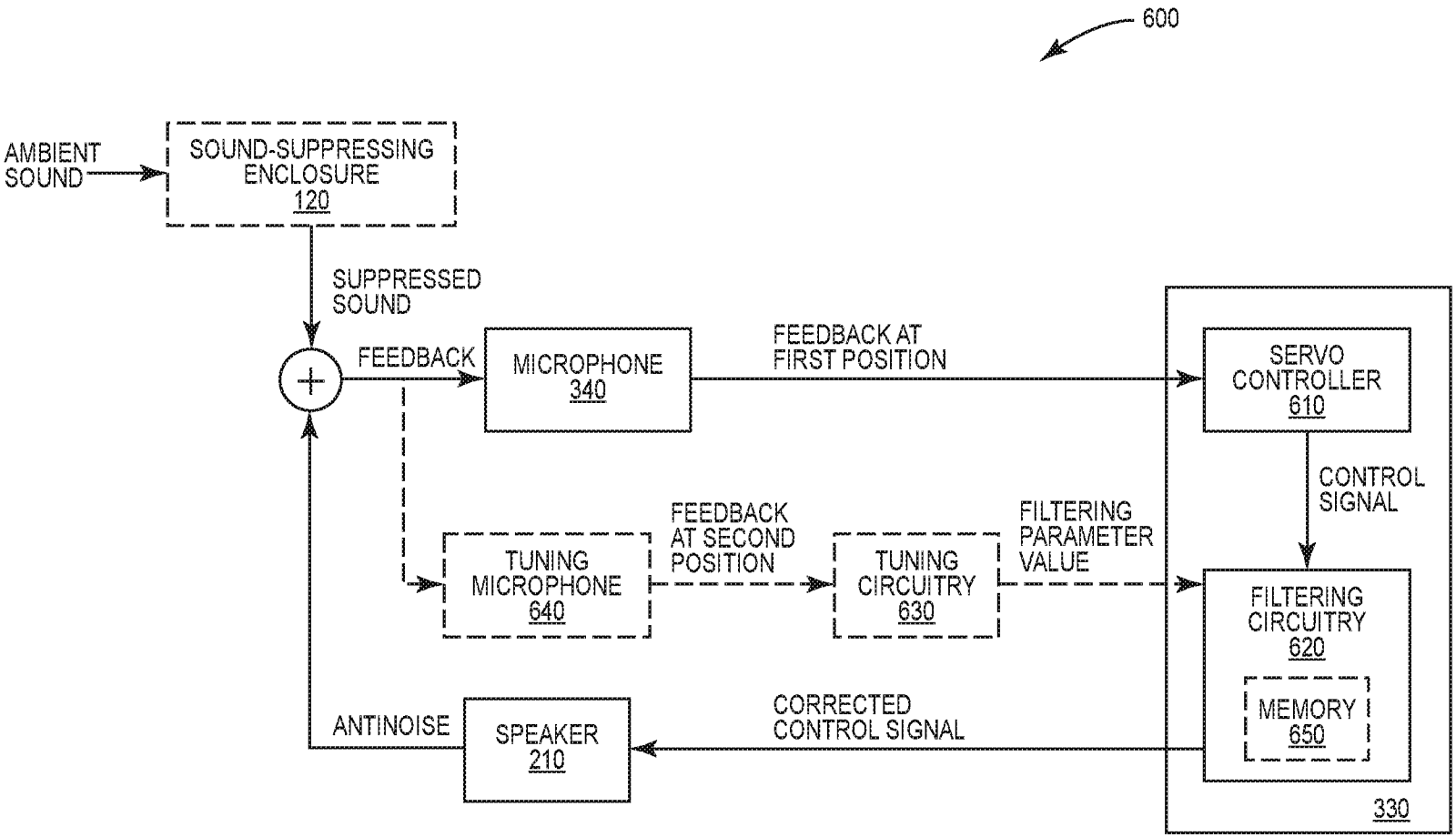

FIG. 6 is a block diagram illustrating an example ANC system, according to aspects of the present disclosure.

Figure 7:
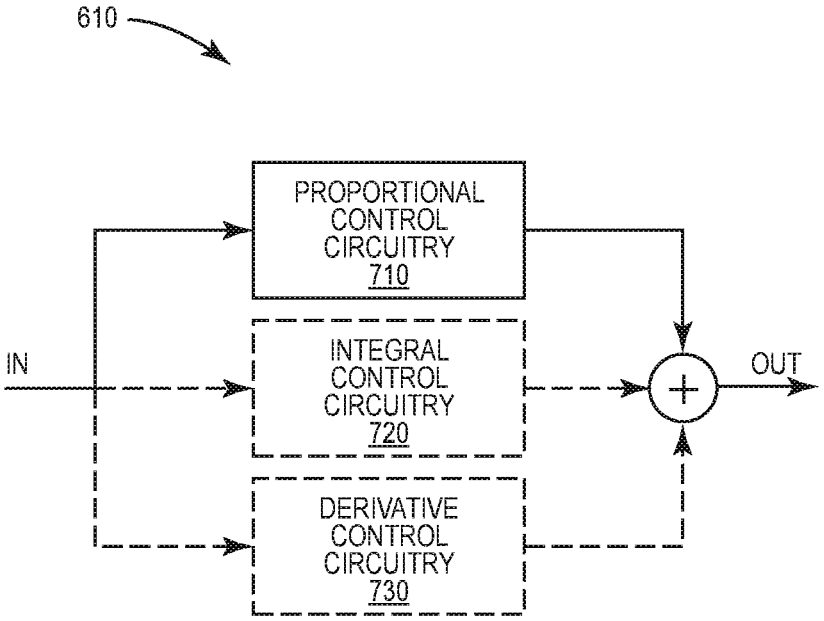

FIG. 7 is a block diagram illustrating an example servo controller, according to aspects of the present disclosure.

FIGS. 8-11 are flow diagrams illustrating an example methods, according to aspects of the present disclosure.

DETAILED DESCRIPTION

Aspects of the present disclosure are generally directed to active noise control (ANC). Particular aspects are suitable for use in vehicles, such as aircraft, spacecraft, rotorcraft, satellites, rockets, terrestrial vehicles, water-borne surface vehicles, water-borne sub-surface vehicles, subterranean vehicles, or any combination thereof. Particular aspects are suitable for commercial, transport, and/or industrial purposes. Different vehicles often present different noise control challenges.

Indeed, techniques that may be effective for noise control in one type of vehicle may be unsuitable for noise control in another type of vehicle. Consider, for example, noise control in a turboprop aircraft as compared to a jet aircraft. In a turboprop aircraft, the majority of the interior sound field is typically related to the propellers, such that noise at one location in the cabin has a coherent relationship to the noise at other locations in the cabin, even at relatively large distances. In such a vehicle, a cancelling field can be effectively produced at one location based on sound input received at a relatively distant location. As long as the complexity of the sound field can be reproduced (which increases with increasing frequency), good noise cancellation can be achieved. Also, since the noise is generally periodic and changes over a relatively slow time scale, adaptation of the control law to cancel the sound is generally not computationally intensive.

In contrast, on a jet aircraft, a significant (if not a majority) of the noise is caused by turbulent flow of air over aircraft surfaces. The typical resulting sound field does not display good coherence (even over small distances) and also changes rapidly over time. Thus, noise sampled from a relatively distant location is often inadequate for producing an effective noise cancelling field elsewhere. This is just one example in which the same approach that works on one vehicle may not be as effective (or may be ineffective) in another vehicle.

There are numerous similar challenges and difficulties in implementing effective noise control solutions in different environments. Various aspects of the present disclosure are suitable for a variety of such environments. At least some of the aspects discussed herein are particularly useful for noise control in vehicles of various types, though other aspects may be useful in other environments in which noise control may be desired. FIG. 1 illustrates an example of an environment in which aspects of the present disclosure may be advantageous. FIG. 1 is a schematic side-view of a portion of an aircraft 100 with a cut-away revealing the interior of a passenger cabin 140. Positioned within the passenger cabin 140 is a seat assembly 110. The seat assembly 110 comprises a seat 130, a headrest 200, and a sound-suppressing enclosure 120.

The sound-suppressing enclosure 120 is disposed within, and spaced from, the interior walls of the aircraft 100. As shown in more detail in the schematic of FIG. 2, the sound-suppressing enclosure 120 has an interior cavity 250 and (as will be explained further below) is configured to produce suppressed sound by suppressing frequencies of ambient sound that enter the interior cavity 250. In some aspects, the sound-suppressing enclosure 120 has a geometry and/or comprises materials such that the suppressed frequencies are above a threshold frequency. The headrest 200 is disposed within the interior cavity 250 of the sound-suppressing enclosure 120, and is mounted to the seat 130.

The headrest 200 comprises a center section 230, which may (in some aspects) be padded and/or molded to comfortably accommodate the head of a passenger (not shown). One or more speakers 210 are mounted to the headrest 200. In the particular example of FIG. 2, the headrest 200 comprises flanges 220*a*, 220*b* extending away from the center section 230 on opposing lateral sides of the center section 230, and a speaker 210*a*, 210*b* is mounted to each of the flanges 220*a*, 220*b*, respectively. The speakers 210*a*, 210*b* are configured to produce antinoise that destructively interferes with frequencies of the suppressed sound. In some aspects, the speakers 210*a*, 210*b* are configured to produce the antinoise such that the frequencies that are destructively interfered with are below the aforementioned threshold frequency.

In some aspects, the sound-suppressing enclosure 120 and the antinoise output from the speakers 210*a*, 210*b* in the headrest 200 work jointly to actively control noise across a broad band of frequencies. For example, in some aspects, the sound-suppressing enclosure 120 is configured to suppress frequencies of ambient sound above the threshold frequency, but as a practical consequence of its design, may (in some aspects) amplify sound frequencies below the threshold frequency. This amplification induced by the sound-suppressing enclosure may, for example, be due to resonance within the interior cavity 250. In some such aspects, the antinoise output from the speakers 210*a*, 210*b* in the headrest 200 is configured to counteract the amplification caused by the sound-suppressing enclosure 120 by destructively interfering with frequencies of the suppressed sound below the threshold frequency. In particular, to destructively interfere with the frequencies below the threshold frequency, the antinoise may be configured to, at a given listening position (e.g., the ear of a listener), destructively interfere by amounts respectively greater than any respective amplification of the frequencies below the threshold frequency induced by the sound-suppressing enclosure 120.

Additionally or alternatively, in some aspects, the antinoise output from the speakers 210*a*, 210*b* is configured to destructively interfere with frequencies below the threshold frequency, but as a practical consequence of its design, may (in some aspects) amplify sound frequencies above the threshold frequency. This amplification induced by the antinoise may, for example, be due to dynamic ambient sound conditions that cause the antinoise to misalign such that some constructive interference occurs. In some such aspects, the sound-suppressing enclosure 120 is configured to counteract the amplification caused by the antinoise output from the speakers 210*a*, 210*b*. In particular, to suppress the frequencies above the threshold frequency, the sound-suppressing enclosure 120 may be configured to, at a given listening position (e.g., the ear of a listener) suppress the frequencies above the threshold frequency by amounts respectively greater than any respective constructive interference of the frequencies above the threshold frequency induced by the antinoise.

Thus, in view of the above, the antinoise and/or sound-suppressing enclosure 120 may jointly contribute to the efficacy of the overall ANC system, e.g., in a complimentary fashion. In some particular aspects, the suppressing (provided by the sound-suppressing enclosure 120) and the destructive interference (provided by the antinoise) jointly provide a peak power reduction of sound energy at a frequency below 200 Hz.

In particular aspects, practical considerations may limit the magnitude on overall sound pressure provided by the sound-suppressing enclosure 120 on a jet aircraft. For example, it may be impractical to seal the sound-suppressing enclosure 120 or otherwise limit a passenger of the aircraft 100 from freely getting in and out of their seat 130. Notwithstanding, the sound-suppressing enclosure 120 may, in some aspects, alter the power spectrum of the ambient noise such that the predominant sound frequency (i.e., the frequency having the most sound energy) is lowered. This may be accomplished with a sound-suppressing enclosure 120 as illustrated schematically in FIG. 2, for example, while still allowing easy ingress and egress (e.g., by having a partially- or fully-open side to the sound-suppressing enclosure 120).

A shift of peak amplitude in the sound power spectrum from high frequencies to low frequencies caused by the sound-suppressing enclosure 120 may provide significant benefit to the overall reduction in sound power, even in aspects in which the overall sound pressure is the same with and without the sound-suppressing enclosure 120. For example, the sound-suppressing enclosure may synergize with the noise controlling effect of antinoise that is more effective at reducing sound at low frequencies, and less effective at high frequencies.

One or more microphones 340 are also disposed within the interior cavity 250 of the sound-suppressing enclosure 120. In the example of FIG. 2, microphones 340*a*, 340*b* are mounted to the front grills of the speakers 210*a*, 210*b*, respectively. The microphones 340*a*, 340*b* are configured to receive feedback comprising a combination of the suppressed sound produced by the sound-suppressing enclosure 120 and the antinoise produced by the speakers 210*a*, 210*b*. Each microphone 340*a*, 340*b* is connected via a respective input line 350*a*, 350*b* to processing circuitry 330, as shown in FIG. 3.

FIG. 3 is schematic of the headrest 200 as viewed from the side, cutaway to reveal example details of the interior of the headrest 200. In this particular example, processing circuitry 330 is disposed within the headrest 200, and is communicatively coupled to the speaker 210 via an output line 360. The processing circuitry 330 is also communicatively coupled to the microphone 340 via an input line 350. The processing circuitry 330 is also connected to a power source (not shown), such as a battery or electrical outlet via power line 390. The processing circuitry 330 is configured to control the speaker 210 to produce the antinoise based on the feedback received by the microphone 340.

The speaker 210, which is mounted to the headrest 200, comprises (among other things) a front grill 320, a mounting bracket 380, a housing 370, and a diaphragm 310. The front grill 320 is disposed over the diaphragm 310 and is mounted to the mounting bracket 380 which mates with the headrest 200 (e.g., using retention clips or screws, not shown). The diaphragm 310 in this example is substantially flat and disposed within the housing 370. The housing 370 is connected to (and retained within the headrest 200 by) the mounting bracket 380.

Although the diaphragm 310 in this example is substantially flat, other aspects of the present disclosure include a diaphragm 310 having any suitable geometry to produce the antinoise (e.g., cone-shaped). In some aspects, a substantially flat diaphragm 310 advantageously provides a smaller distance between the diaphragm 310 and the microphone 340 mounted to the front grill 320 as compared to geometries that use a diaphragm 310 that is concave within the housing 370. In some such aspects, this relatively smaller distance reduces the delay in the transfer function between the speaker 210 and the microphone 340, which results in a higher bandwidth error rejection and increased performance. Indeed, aspects that include small distances between the diaphragm 310, the microphone 340, and the ear of a listener may keep differences in sound energy at those respective locations small so that benefits in error rejection are similar.

A speaker 210 that acts as a uniform source is generally preferable over a speaker that produces significant diffraction, or in which diffraction occurs at frequencies in which noise control is less effective. In some aspects, the speaker 210 is of a relatively small diameter (e.g., 2.5 inches), which may serve to reduce diffraction that undermines the efficacy of the emitted antinoise. Although a single, larger speaker (e.g., 8 inches in diameter) mounted to the center section 230 may, in some aspects, serve a similar purpose in reducing diffraction (as compared to smaller speakers 210*a*, 210*b* mounted to the flanges 220*a*, 220*b*, respectively), the diffraction caused by a relatively larger speaker 210 may occur at a lower frequency where noise control is generally less effective. If diffraction occurs at a given frequency, variation of phase and/or amplitude in the sound field may spatially decrease the desirable effects of ANC.

FIGS. 4A, 4B, 4C, and 4D are top-down schematic views of the headrest 200 according to various aspects. In FIG. 4A, the flanges 220*a*, 220*b* are canted inward (e.g., towards the head 400 of a listener, if present), such that projection axes 420*a*, 420*b* extending in the direction in which the antinoise is projected from the center of each of the speakers 210*a*, 210*b*, respectively, intersect at an angle θ. In this example, the angle θ of intersection between the projection axes 420*a*, 420*b* is 50 degrees, as each flange 220*a*, 220*b* is canted at an angle α of 25 degrees relative to a longitudinal axis 430 of the center section 230. In this particular example, the proportions of the headrest 200, mounting positions of the speakers 210*a*, 210*b*, and angle α of the flanges 220*a*, 220*b* relative to the longitudinal axis 430 of the center section 230 are such that the projection axes 420*a*, 420*b* advantageously pass through the ears 410*a*, 410*b* of the listener.

In some aspects, placement of speakers 210*a*, 210*b* in the headrest 200 at angle α toward the ears 410*a*, 410*b* of the listener as shown in FIG. 4A reduces the latency between the speakers 210*a*, 210*b* and the listener as compared to the headrest 200 illustrated in FIG. 4B, while also reducing the passive amplification impact of the speakers 210*a*, 210*b*, as compared to placement at an angle of 90 degrees as shown in FIG. 4C. Indeed, in some aspects, the perpendicular orientation of the speakers 210*a*, 210*b* relative to the center section 230 may cause a local resonant amplification of sound frequencies in the range from 500 to 1000 Hz. Since this is a range where feedback control of sound may be less effective in some aspects, passive amplification of this kind has the potential to negatively impact overall closed-loop performance. Thus, although aspects of the present disclosure may include an arrangement as shown in FIG. 4C, particular aspects which use the smaller angle α depicted in FIG. 4A, which may result in relatively little passive amplification of the sound field (or indeed, none whatsoever, in some aspects).

Other aspects of the present disclosure include a headrest 200 in which the flanges 220*a*, 220*b* are not angled inward, as shown in FIG. 4B, such that the projection axes 420*a*, 420*b* do not intersect. While this configuration avoids some or all of the passive resonant amplification of the speakers 210*a*, 210*b* discussed above with respect to the arrangement illustrated in FIG. 4C, the speakers 210*a*, 210*b* are placed at positions further away from the ears 410*a*, 410*b* of the listener, which may introduce more error between the antinoise generated by the ANC system and the sound energy at the listener's ears 410*a*, 410*b* relative to the arrangement illustrated in, e.g., FIG. 4A.

Of course, an additional design concern for the headrest 200 is the comfort of the person whose head 400 rests in it, which is often a matter of personal taste. For example, a person may find the headrest 200 arrangement illustrated in FIG. 4C preferable to those in FIGS. 4A and 4B when trying to sleep because it may prevent the head 400 from jostling around during turbulent flight conditions. As another example, a person may find the headrest 200 arrangement illustrated in FIG. 4A or 4B preferable to that illustrated in FIG. 4C while eating due to the increased freedom of head 400 movement available.

In view of the above, the headrest 200 may, in some aspects, be flexible and/or jointed such that the headrest 200 is able to be selectively positioned in accordance with FIGS. 4A, 4B, and/or 4C. For example, as shown in the example schematic of FIG. 5, the headrest 200 may comprise one or more hinges 500 between the center section 230 and any or all of the flanges 220 to permit the flange(s) 220 to be positioned to any angle α as may be desired. Although in some aspects of the present disclosure, the speakers 230*a*, 230*b* mounted to the flanges 220*a*, 220*b* are configured to project the antinoise at respective projection axes 420*a*, 420*b* that intersect at an optimum angle that minimizes latency and avoids passive amplification at a given listening position, in some aspects, a user may be able to move the flanges 220*a*, 220*b* such that the headrest 200 is arranged in accordance with any of FIG. 4A, 4B, or 4C, as desired. This may, in some aspects, allow a user to balance physical comfort concerns with noise control efficacy according to their own preferences, for example.

In addition, as will be explained further below, aspects of the present disclosure allow the processing circuitry 330 to be tuned through the use of a feedback loop. FIG. 4D is a top-view schematic illustrating an example headrest 200 to which a tuning microphone 640 is mounted via a boom 490. In some aspects, the boom is flexible to permit the tuning microphone 640 to be positioned to a listening position 480, such as the likely location of one or the other of a typical listener's ears 410*a*, 410*b*. In some aspects, the tuning microphone 640 may be freely coupled and decoupled to the processing circuitry 330 (not shown) as needed in order to tune the ANC system (e.g., via a tuning port 485 that provides tuning input to the processing circuitry 330).

In view of the above, FIG. 6 illustrates an example ANC system 600 which, according to various aspects of the present disclosure, is useful in whole or in part with the above-described headrest 200. The ANC system 600 comprises a microphone 340, processing circuitry 330, and a speaker 210. In general, the processing circuitry 330 is configured to control the speaker 210 to produce antinoise that destructively interferes with ambient sound to produce feedback. The microphone 340 is configured to receive the feedback (which comprises a combination of the ambient sound and antinoise), and provide that feedback to the processing circuitry 330 for further use in performing ANC. In this example, the processing circuitry 330 is configured to control the speaker 210 to produce the antinoise without feedforward control.

In some aspects, the ANC system 600 further comprises the above-discussed sound-suppressing enclosure 120. In such aspects, the ambient sound enters an interior cavity 250 of the sound-suppressing enclosure 120 and is suppressed as discussed above to produce suppressed sound. In such aspects, the antinoise destructively interferes with the suppressed sound to produce feedback that is received by the microphone 340.

The microphone 340 is located at a first position (e.g., mounted to the front grill 320 of the speaker 210). The microphone sends the feedback received at the first position to the processing circuitry 330. The processing circuitry 330 comprises a servo controller 610 and filtering circuitry 620, which are communicatively connected to each other. Based on the feedback received at the first position by the microphone 340, the servo controller 610 generates a control signal which the filtering circuitry 620 uses to generate a corrected control signal. In some particular aspects, the filtering circuitry 620 generates the corrected control signal based on the control signal from the servo controller 610 and one or more filtering parameters. In various aspects of the present disclosure, one, some, or all of these filtering parameters are configurable, as will be further discussed below. The filtering circuitry 620 sends the corrected control signal to the speaker 210 to produce the antinoise, which (as discussed above) combines with the ambient or suppressed sound to provide feedback to the servo controller 610 via the microphone 340. Thus, the ANC system 600 comprises a feedback loop by which effective noise control is achieved.

Although the control signal produced by the servo controller 610 may be effective at controlling the speaker 610 to produce antinoise without the correction performed by the filtering circuitry 620, such a servo controller 610 may be designed to provide high overall control performance which, in some aspects, may actually amplify certain frequencies (e.g., one or more frequencies above the threshold frequency). Accordingly, in some aspects, the filtering circuitry 620 tailors the control signal so that the antinoise destructively interferes with the ambient or suppressed sound such that this amplification is suppressed.

The correction introduced by the filtering circuitry 620 may, in some aspects, be tuned through the use of a tuning microphone 640 and tuning circuitry 630, which (in some aspects) may be pluggable into, and removable from, the ANC system 600 as desired. The tuning microphone 640 is placed at a second position, spaced apart from the microphone 340. In aspects that include the sound-suppressing enclosure 120, the tuning microphone 640 may also be disposed within the interior cavity 250. In particular aspects, the tuning microphone 640 may be positioned closer to where a listener's ear 410 is expected to be, e.g., by suspending the tuning microphone 640 on the end of a boom (not shown), mounted to the center section 230 of the headrest 200, or by other means.

The tuning microphone 640 is communicatively coupled to the tuning circuitry 630, and is configured to receive further feedback comprising a different combination of the ambient (or suppressed) sound and the antinoise (i.e., a combination as observed from the second position rather than from the first position where the microphone 340 is located). The tuning microphone 640 is further configured to provide the further feedback to the tuning circuitry 630. The tuning circuitry 630 is configured to receive the further feedback from the tuning microphone 640, and based on the further feedback, store different values of the configurable filtering parameter(s) in the filtering circuitry 620 over time.

In one particular example, while the ANC system 600 is being tuned (e.g., at a manufacturer or installer of the ANC system 600), simulated or prerecorded noise may be used as the ambient sound, and the tuning circuitry 630 may use a genetic algorithm in which values of various filtering parameters are provided to the filtering circuitry 620 over time while resultant noise control performance is monitored. Over multiple feedback loop iterations and over time, the best performing filtering parameters (e.g., the filtering parameter(s) that most reduce the a-weighted Root Mean Square (RMS) sound pressure) may be then be stored in the filtering circuitry 620 (e.g., in a memory 650) for subsequent use (e.g., during actual operation of the vehicle).

In some aspects, the servo controller 610 performs one or more proportional (P), integral (I), and/or derivative (D) control functions based on the feedback to produce a control signal that is useful for controlling the speaker 210 to produce antinoise. Thus, in some aspects, the servo controller 610 is a P controller, a PI controller, a PID controller, or a PD controller.

FIG. 7 illustrates an example servo controller 610, according to particular aspects of the present disclosure. The servo controller 610 comprises proportional control circuitry 710.

In some aspects, the servo controller 610 further comprises integral control circuitry 720 and/or derivative control circuitry 730.

In particular, the servo controller 610 may be a P controller in which the proportional control circuitry 710 produces a control signal for outputting antinoise from the speaker 210 in proportion to the feedback received at the microphone 340. In other aspects, the servo controller 610 may be a PI controller that further comprises the integral control circuitry 720. In such aspects, the proportional control circuitry 710 may contribute predominantly to the control signal, and the integral control circuitry 720 may be configured to take an integral of the antinoise over time, which is combined with the output from the proportional control circuitry 710 to smooth out error or deviance between the feedback and the sound to be controlled.

Alternatively, the servo controller 610 may be a PD controller or a PID controller that comprises the derivative control circuitry 730. The derivative control circuitry 730 is configured to produce an output that shapes the output of the proportional control circuitry 710 (and integral control circuitry 720, if present) based on a rate of change to the input to the servo controller 610. By factoring in the rate of change, the servo controller 610 attempts to predict and compensate for future errors between the antinoise and sound to be controlled. Thus, the derivative control circuitry 730 may be included in the servo controller 610 when the servo controller 610 will be used to control noise in a stable, predictable, and/or uniform sound environment (e.g., in a turboprop aircraft). Correspondingly, the derivative control circuitry 730 may be omitted from the servo controller 610 when the servo controller 610 will be used in a highly-complex and/or unpredictable sound environment (e.g., in a jet aircraft).

Figure 8:
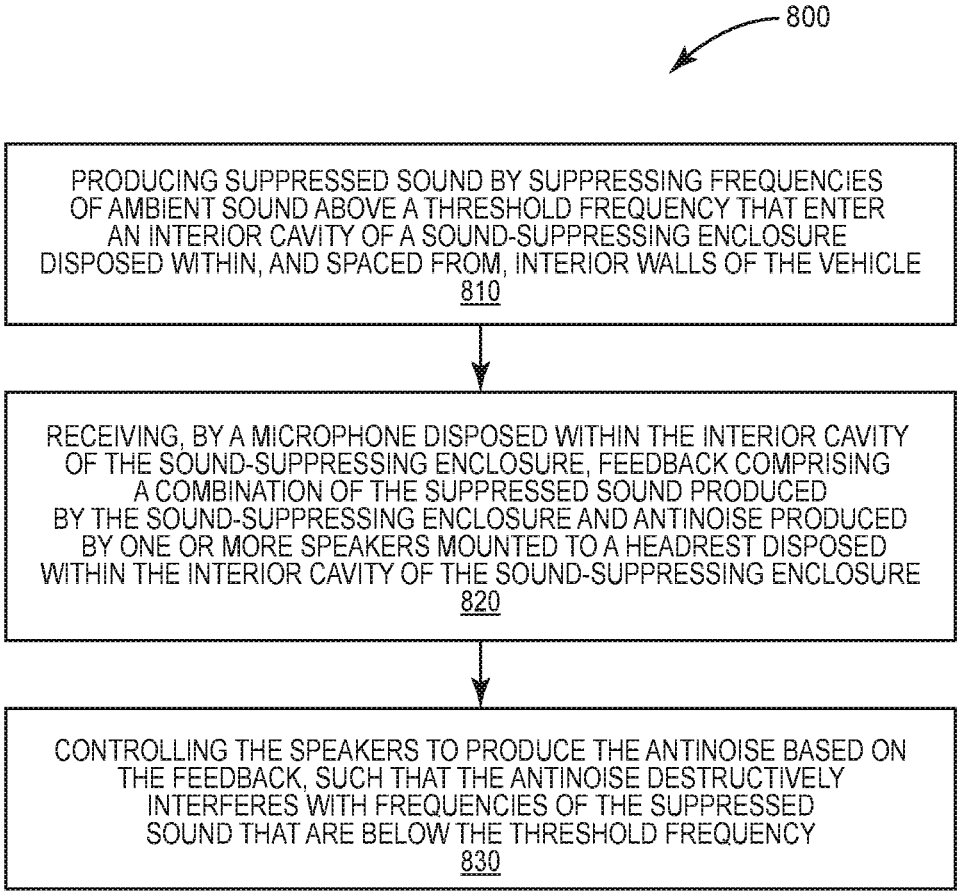

In view of all of the above, FIG. 8 illustrates an example method 800 of performing ANC within a vehicle, according to various aspects of the present disclosure. The method 800 comprises producing suppressed sound by suppressing frequencies of ambient sound above a threshold frequency that enter an interior cavity of a sound-suppressing enclosure 120 disposed within, and spaced from, interior walls of the vehicle (block 810). The method 800 further comprises receiving, by a microphone 340 disposed within the interior cavity 250 of the sound-suppressing enclosure 120, feedback comprising a combination of the suppressed sound produced by the sound-suppressing enclosure 120 and antinoise produced by one or more speakers 210 mounted to a headrest 200 disposed within the interior cavity 250 of the sound-suppressing enclosure 120 (block 820). The method 800 further comprises controlling the speakers 210 to produce the antinoise based on the feedback, such that the antinoise destructively interferes with frequencies of the suppressed sound that are above the threshold frequency (block 830).

Figure 9:
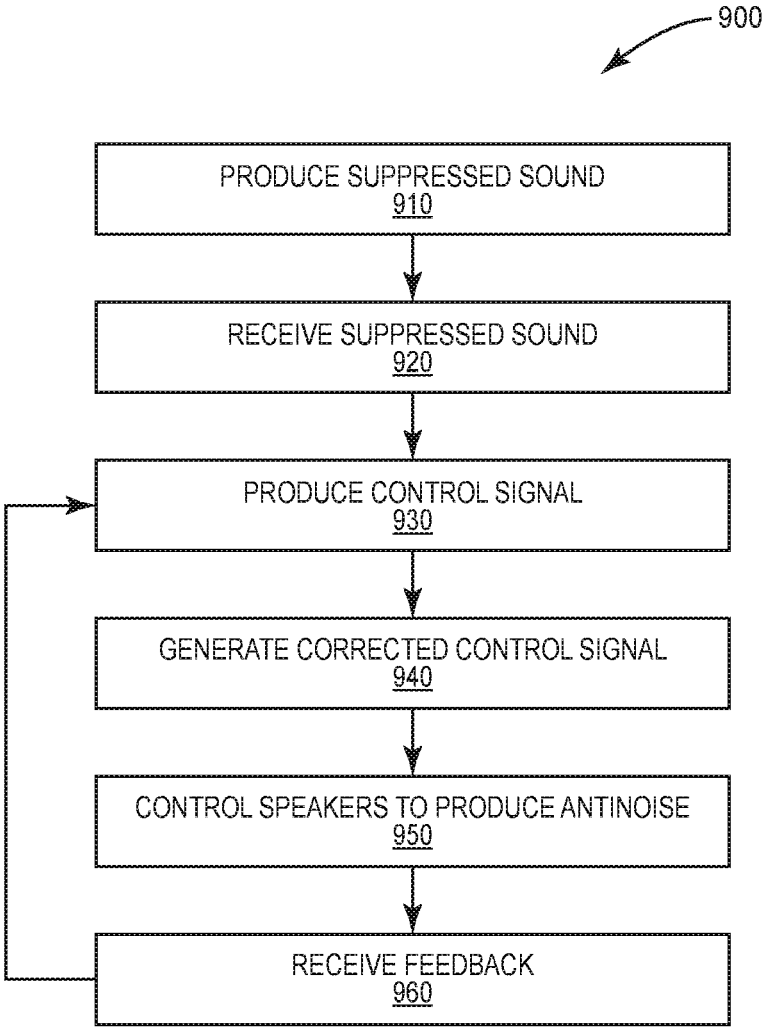

FIG. 9 illustrates a more detailed example method 900 of performing ANC within a vehicle. The method 900 comprises producing suppressed sound by suppressing frequencies of ambient sound according to aspects discussed above (e.g., using a sound-suppressing enclosure 120) (block 910). The method 900 further comprises receiving the suppressed sound using a microphone 340 (block 920) and producing a control signal (e.g., using a servo controller 610), according to aspects discussed above (block 930). The method 900 further comprises generating a corrected control signal (e.g., using filtering circuitry based on the suppressed sound) (block 940), and controlling the speakers to produce antinoise (block 950) in accordance with aspects discussed above. The method 900 further comprises receiving feedback comprising suppressed sound and the antinoise (block 960) and again producing a control signal (block 930), and so on, as discussed above.

Figure 10:
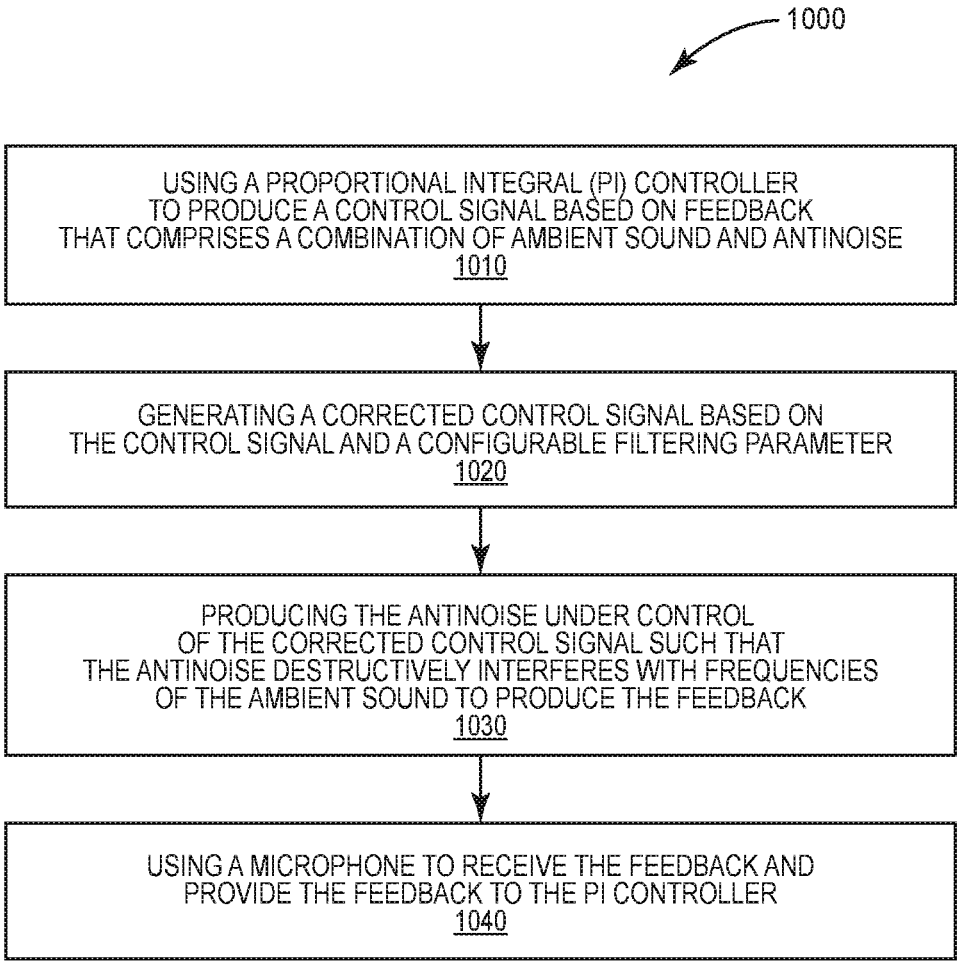

FIG. 10 illustrates another method 1000 implemented by an ANC system 600. The method 1000 comprises using a PI controller to produce a control signal based on feedback that comprises a combination of ambient sound and antinoise (block 1010). The method 1000 further comprises generating a corrected control signal based on the control signal and a configurable filtering parameter (block 1020). The method 1000 further comprises producing the antinoise under control of the corrected control signal such that the antinoise destructively interferes with frequencies of the ambient sound to produce the feedback (block 1030). The method further comprises using a microphone to receive the feedback and provide the feedback to the PI controller (block 1040).

Figure 11:
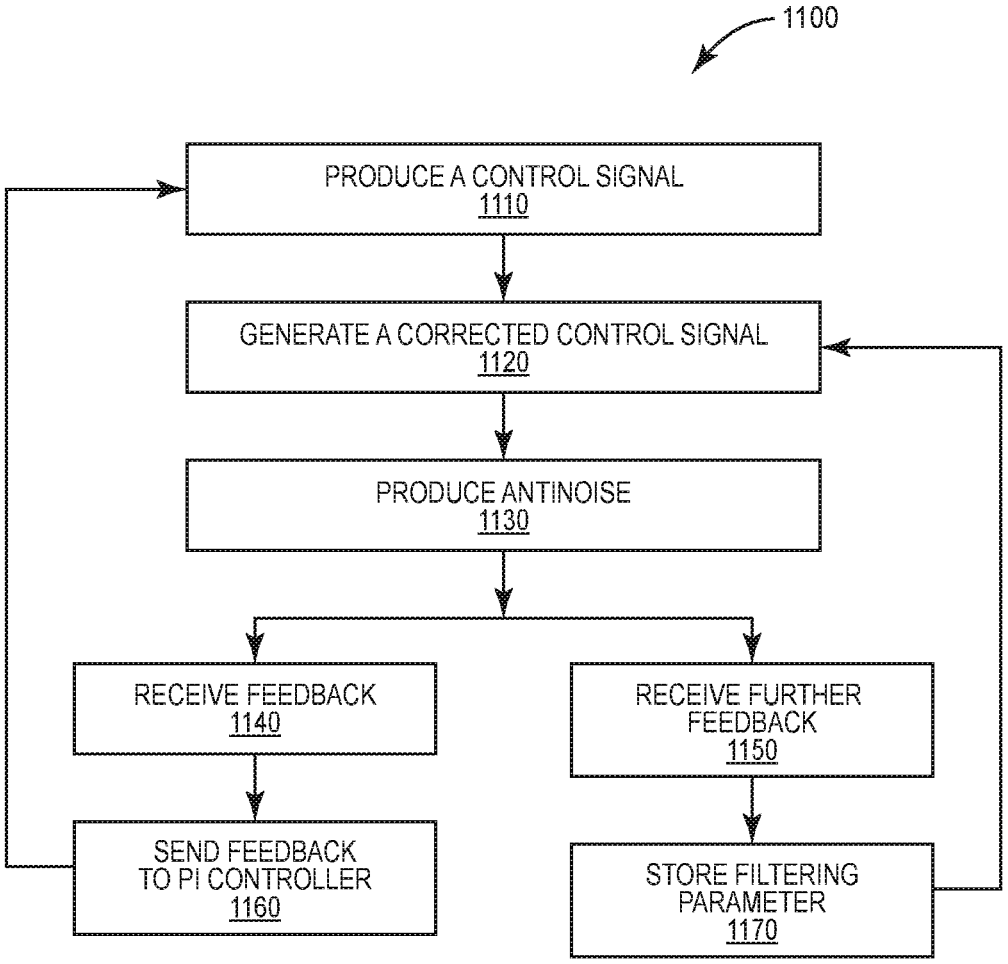

FIG. 11 illustrates a more detailed method 1100 implemented by an ANC system 600. The method 1100 comprises producing a control signal (e.g., using a PI controller), in accordance with aspects discussed above (block 1110). The method 1100 further comprises generating a corrected control signal (e.g., based on the control signal and a configurable filtering parameter) in accordance with aspects discussed above (block 1120). The method 1100 further comprises producing antinoise in accordance with aspects discussed above (block 1130). The method 1100 further comprises receiving feedback (e.g., using a microphone 340) (block 1140) and receiving further feedback (e.g., using a tuning microphone 640) (block 1150), in accordance with aspects discussed above. The method further comprises sending the feedback to the PI controller (block 1160) for continued production of the control signal (block 1110), and storing a filtering parameter (e.g., in filtering circuitry 620) for use in further generating the corrected control signal (block 1120).

Those skilled in the art will appreciate that the various methods and processes described herein may be implemented using various hardware configurations that generally, but not necessarily, include the use of one or more microprocessors, microcontrollers, digital signal processors, or the like, coupled to memory storing software instructions or data for carrying out the techniques described herein. In particular, those skilled in the art will appreciate that the circuits of various aspects may be configured in ways that vary in certain details from the broad descriptions given above. For instance, one or more of the processing functionalities discussed above may be implemented using dedicated hardware, rather than a microprocessor configured with program instructions. Such variations, and the engineering tradeoffs associated with each, will be readily appreciated by the skilled practitioner. Since the design and cost tradeoffs for the various hardware approaches, which may depend on system-level requirements that are outside the scope of the present disclosure, are well known to those of ordinary skill in the art, further details of specific hardware implementations are not provided herein.

Aspects of the present disclosure may additionally or alternatively include one or more aspects of the claims enumerated below, and/or any compatible combination of features described herein. The present invention may, of course, be carried out in other ways than those specifically set forth herein without departing from essential characteristics of the invention. The present aspects are to be considered in all respects as illustrative and not restrictive, and all changes coming within the meaning and equivalency range of the appended claims are intended to be embraced therein. Although steps of various processes or methods described herein may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention.

What is claimed is:

1. An active noise control (ANC) system comprising:

a sound-suppressing enclosure disposed within, and spaced from, interior walls of a vehicle, the sound-suppressing enclosure having an interior cavity and being configured to produce suppressed sound by suppressing frequencies of ambient sound above a threshold frequency that enter the interior cavity;

a headrest disposed within the interior cavity of the sound-suppressing enclosure;

speakers mounted to the headrest and configured to produce antinoise that destructively interferes with frequencies of the suppressed sound that are below the threshold frequency;

a microphone disposed within the interior cavity of the sound-suppressing enclosure, wherein the microphone is configured to receive feedback comprising a combination of the suppressed sound produced by the sound-suppressing enclosure and the antinoise produced by the speakers;

processing circuitry communicatively coupled to the speakers and the microphone, wherein the processing circuitry is configured to control the speakers to produce the antinoise based on the feedback received by the microphone;

wherein the headrest comprises a center section and flanges extending away from the center section on opposing lateral sides of the center section, wherein at least one of the speakers is mounted to each of the flanges; and wherein the speakers mounted to the flanges are configured to project the antinoise at respective projection axes that intersect at an angle between 10 and 90 degrees.

2. The ANC system of claim 1, wherein the processing circuitry comprises:

a proportional integral (PI) controller configured to produce a control signal based on the feedback received by the microphone;

filtering circuitry communicatively coupled to the PI controller, wherein the filtering circuitry is configured to:

generate a corrected control signal based on the control signal from the PI controller and a configurable filtering parameter;

send the corrected control signal to the speakers to control the speakers to produce the antinoise.

3. The ANC system of claim 2, further comprising:

a tuning microphone disposed within the interior cavity of the sound-suppressing enclosure and spaced apart from the microphone, wherein the tuning microphone is configured to receive further feedback comprising a different combination of the suppressed sound produced by the sound-suppressing enclosure and the antinoise produced by the speakers;

tuning circuitry communicatively coupled to the tuning microphone and the filtering circuitry, wherein the tuning circuitry is configured to store different values of the configurable filtering parameter in the filtering circuitry over time based on the further feedback from the tuning microphone.

4. The ANC system of claim 1, wherein to suppress the frequencies above the threshold frequency, the sound-suppressing enclosure is configured to, at a given listening position, suppress the frequencies above the threshold frequency by amounts respectively greater than any respective constructive interference of the frequencies above the threshold frequency induced by the antinoise.

5. The ANC system of claim 1, wherein to destructively interfere with the frequencies below the threshold frequency, the antinoise is configured to, at a given listening position, destructively interfere by amounts respectively greater than any respective amplification of the frequencies below the threshold frequency induced by the sound-suppressing enclosure.

6. The ANC system of claim 1, wherein the sound-suppressing enclosure and processing circuitry are configured to jointly provide a peak power reduction of sound energy at a frequency below 200 Hz.

7. The ANC system of claim 1, wherein the processing circuitry is configured to control the speakers to produce the antinoise without feedforward control.

8. The ANC of claim 1, wherein microphone is mounted to a front of one of the speakers.

9. The ANC of claim 1, wherein the processing circuitry is disposed within the headrest and is communicatively coupled to one of the speakers through an output line that is positioned at the headrest.

10. An aircraft comprising:

a passenger cabin;

a seat disposed within the passenger cabin;

a sound-suppressing enclosure disposed within, and spaced from, interior walls of the passenger cabin, the sound-suppressing enclosure having an interior cavity and being configured to produce suppressed sound by suppressing frequencies of ambient sound above a threshold frequency that enter the interior cavity;

a headrest mounted to the seat and disposed within the interior cavity of the sound-suppressing enclosure;

speakers mounted to the headrest and configured to produce antinoise that destructively interferes with frequencies of the suppressed sound that are above the threshold frequency;

a microphone disposed within the interior cavity of the sound-suppressing enclosure, wherein the microphone is configured to receive feedback comprising a combination of the suppressed sound produced by the sound-suppressing enclosure and the antinoise produced by the speakers;

processing circuitry communicatively coupled to the speakers and the microphone, wherein the processing circuitry is configured to control the speakers to produce the antinoise based on the feedback received by the microphone;

wherein the headrest comprises a center section and flanges extending away from the center section on opposing lateral sides of the center section, wherein at least one of the speakers is mounted to each of the flanges; and wherein the speakers mounted to the flanges are configured to project the antinoise at respective projection axes that intersect at an angle between 10 and 90 degrees.

11. The aircraft of claim 10, wherein the processing circuitry comprises:

a proportional integral (PI) controller configured to receive the feedback from the microphone and produce a control signal;

filtering circuitry communicatively coupled to the PI controller, wherein the filtering circuitry is configured to generate a corrected control signal based on the control signal from the PI controller, and send the corrected control signal to the speakers to produce the antinoise.

12. The aircraft of claim 10, wherein to suppress the frequencies of ambient sound above the threshold frequency, the sound-suppressing enclosure is configured to, at a given listening position, suppress the frequencies above the threshold frequency by amounts respectively greater than any respective constructive interference of the frequencies above the threshold frequency induced by the antinoise.

13. The aircraft of claim 10, wherein to destructively interfere with the frequencies below the threshold frequency, the antinoise is configured to, at a given listening position, destructively interfere by amounts respectively greater than any respective amplification of the frequencies below the threshold frequency induced by the sound-suppressing enclosure.

14. The aircraft of claim 10, wherein the sound-suppressing enclosure and processing circuitry are configured to jointly provide a peak power reduction of sound energy at a frequency below 200 Hz.

15. The aircraft of claim 10, wherein the processing circuitry is configured to control the speakers to produce the antinoise without feedforward control.

16. The ANC of claim 10, wherein the sound-suppressing enclosure is positioned at the headrest of the seat and is spaced away from a floor of the passenger cabin.

17. A method of performing active noise control (ANC) within a vehicle, the method comprising:

producing suppressed sound by suppressing frequencies of ambient sound above a threshold frequency that enter an interior cavity of a sound-suppressing enclosure disposed within, and spaced from, interior walls of the vehicle;

receiving, by a microphone disposed within the interior cavity of the sound-suppressing enclosure, feedback comprising a combination of the suppressed sound produced by the sound-suppressing enclosure and antinoise produced by speakers mounted to a headrest disposed within the interior cavity of the sound-suppressing enclosure;

projecting the antinoise at respective projection axes that intersect at an angle between 10 and 90 degrees from the headrest that comprises a center section and flanges on opposing sides and with one of the speakers mounted within each of the flanges; and controlling the speakers to produce the antinoise based on the feedback, such that the antinoise destructively interferes with frequencies of the suppressed sound that are below the threshold frequency.

18. The method of claim 17, wherein controlling the speakers to produce the antinoise based on the feedback comprises:

using a proportional integral (PI) controller to produce a control signal based on the feedback;

using filtering circuitry to generate a corrected control signal based on the control signal; and sending the corrected control signal to the speakers to control the speakers to produce the antinoise.

19. The method of claim 17, wherein suppressing the frequencies above the threshold frequency comprises, at a given listening position, suppressing the frequencies above the threshold frequency by amounts respectively greater than any respective constructive interference of the frequencies above the threshold frequency induced by the antinoise.

20. The method of claim 17, wherein controlling the speakers such that the antinoise destructively interferes with the frequencies below the threshold frequency comprises, at a given listening position, controlling the speakers such that the antinoise destructively interferes by amounts respectively greater than any respective amplification of the frequencies below the threshold frequency induced by the enclosure.

21. The method of claim 17, wherein the suppressing and the destructive interference jointly provide a peak power reduction of sound energy at a frequency below 200 Hz, and controlling the speakers to produce the antinoise is performed without feedforward control.

22. The method of claim 17, further comprising positioning each of the flanges at a common angle relative to the center section.

* * * * *